United States Patent [19]

Ansai et al.

[11] 4,054,936

[45] Oct. 18, 1977

[54] GAS IGNITION DEVICE

[75] Inventors: Yasuhiro Ansai; Hideo Mifune, both of Hirakata; Kenroku Tani, Katano, all of Japan

[73] Assignee: Matsushita Electric Industrial Co., Ltd., Osaka, Japan

[21] Appl. No.: 667,359

[22] Filed: Mar. 16, 1976

[51] Int. Cl.[2] ..... F23Q 3/00

[52] U.S. Cl. ..... 361/257; 310/318; 361/260

[58] Field of Search ..... 317/96; 310/8.1, 8.2; 331/176

[56] References Cited

U.S. PATENT DOCUMENTS

| | | | |
|---|---|---|---|
| 3,364,393 | 1/1968 | Rabe | 317/96 |
| 3,679,918 | 7/1972 | Keizi | 310/8.1 |
| 3,700,936 | 10/1972 | Shimizu | 310/8.2 |
| 3,736,446 | 5/1973 | Berlincourt et al. | 310/8.1 |
| 3,790,826 | 2/1974 | Kawada | 310/8.1 |
| 3,796,897 | 3/1974 | Sakurai | 310/8.1 |
| 3,824,432 | 7/1974 | Gersing | 317/96 |
| 3,850,570 | 11/1974 | Remy et al. | 317/96 |
| 3,883,246 | 5/1975 | Courier de Mere | 317/96 |
| 3,889,160 | 6/1975 | Cobarg | 317/96 |

*Primary Examiner*—Gerald P. Tolin
*Assistant Examiner*—Clifford C. Shaw
*Attorney, Agent, or Firm*—Stevens, Davis, Miller & Mosher

[57] ABSTRACT

A small-sized gas ignition device comprising a self-oscillation circuit, a piezo-electric transformer which steps up the output of the self-oscillation circuit, a capacitor which accumulates the output voltage of the piezo-electric transformer, and a discharging gap which is connected in parallel with the capacitor and is adapted to discharge the accumulated voltage for performing gas ignition. With this device gas ignition is obtained with certainty by single operation requiring only a light touch.

2 Claims, 5 Drawing Figures

GAS IGNITION DEVICE

The present invention relates to a gas ignition device in which a high voltage is generated. and then applied to a discharging gap thereby causing electric discharge across the gap for gas ignition, in particular, to a gas ignition device suitable for lighters.

In a gas ignition device according to the prior art, a piezo-electric ceramic material is compressed by a mechanical external force thereby causing a high electric voltage to be generated upon removal of the external pressure, whose discharge energy is used for gas ignition. Though two methods have been known for applying the external pressure, it is not possible for either of them to produce ignition by a light touch and also eliminate the noise accompanying the ignition operation. Further, in a prior art gas ignition device of the type in which a piezo-electric ceramic material has a mechanical external force applied thereto to generate a high electric voltage, the high voltage discharges only once for every ignition operation thus possibly resulting in mis-operation.

Accordingly, the present invention is directed to the elimination of these disadvantages in the gas ignition device.

The first object of the present invention is to provide a gas ignition device which can be ignited by a light touch without any sound accompanying the ignition operation.

The second object of the present invention is to provide a gas ignition device in which discharge can be made to occur a plurality of time for one ignition operation thereby ensuring reliable ignition.

The third object of the present invention is to provide a gas ignition device which is so constituted that the number of discharges for one ignition operation is limited to control the source battery so that there is a minimum consumption of energy.

The fourth object of the present invention is to provide a gas ignition device which can be made small in size by a suitable electric circuit.

Figure 1:
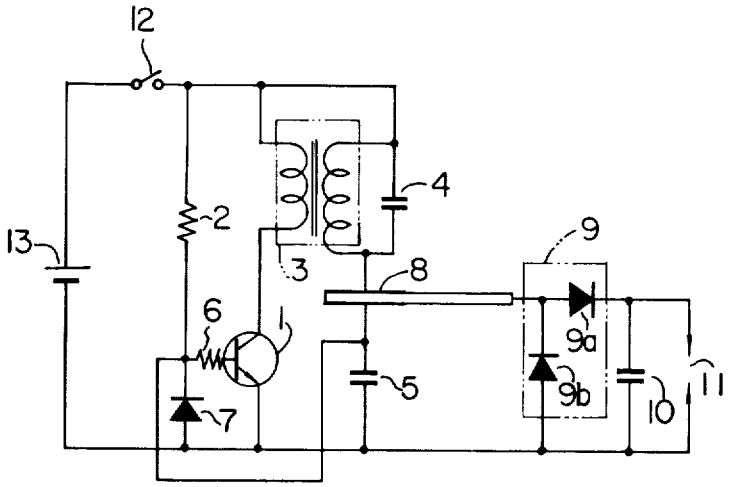
Figure 2:
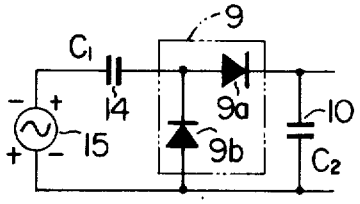
Figure 3:
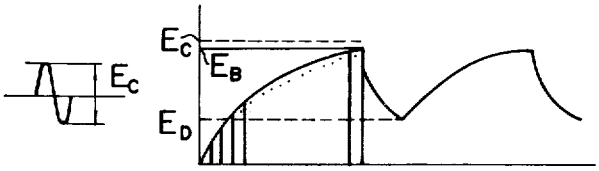
Figure 4:
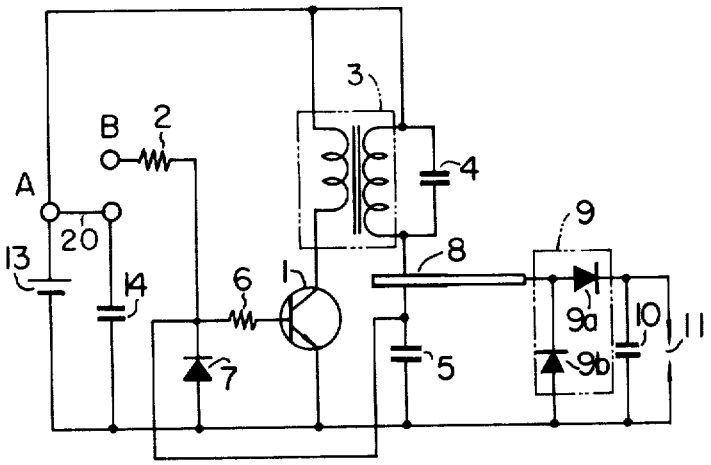
Figure 5:
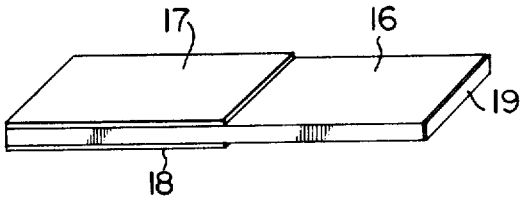

These and other objects and advantages of the present invention will become apparent from the following detailed description taken in connection with the accompanying drawings in which:

FIG. 1 is a circuit diagram of an embodiment of a gas ignition device according to the present invention, FIGS. 2 and 3 are explanatory diagrams each showing a discharge energy storing capacitor being charged, FIG. 4 is a circuit diagram of another embodiment of a gas ignition device according to the present invention, and FIG. 5 is an enlarged perspective view of a piezo-electric transformer.

Referring to FIG. 1 showing an embodiment of a gas ignition device according to the present invention, reference numeral 1 is a self-oscillation transistor which operates at class C. Numeral 2 is a bias resistor for starting the oscillation of the transistor 1, numeral 3 is an oscillation transformer, numerals 4 and 5 are capacitors which adjust the phase of the feed-back loop so as to satisfy the oscillation condition, numeral 6 is a resistor which limits the base current of the transistor 1, numeral 7 is a diode which serves to lengthen the conduction time interval of the transistor 1, numeral 8 is a piezo-electric transformer which steps up the oscillating voltage generated in the capacitor 4 thereby serving as a high voltage source, numeral 9 is a switching element which comprises two diodes 9*a* and 9*b* connected as shown in the drawings and transforms and transfers the high voltage energy generated on the secondary side of the piezo-electric transformer 8 to an energy storing capacitor 10, numeral 11 is a discharging gap, and numeral 12 is a source switch which connects and disconnects a battery 13 to and from the circuit, respectively.

The piezo-electric transformer 8 comprises, as generally shown in FIG. 5, a rectangular piezo-electric ceramic plate 16 which is provided with a pair of electrodes 17 and 18 on respective portions of its upper and lower surfaces and an electrode 19 on the longitudinal end surface. Thus, the piezo-electric ceramic plate 16 is polarized in the direction of thickness at the portion between the electrodes and is polarized in the direction of its length at the remaining portion. When an electric voltage which is equal in frequency to the proper resonance frequency of the piezo-electric ceramic plate 16 determined by its longitudinal size is applied between the primary side electrodes 17 and 18 of the piezo-electric transformer 8, a mechanical oscillation is excited in the direction of length of the piezo-electric ceramic plate 16 because of the piezo-electric effect thus causing a high electric voltage to be generated on the secondary side electrode 19.

The transistor 1, the bias resistor 2, the oscillation transformer 3, the capacitors 4 and 5, the resistor 6, the diode 7 and the piezo-electric transformer 8 constitute a self-oscillation circuit. When the switch 12 is turned on, the self-oscillation circuit is activated and, when the capacity of the capacitor 5 is larger than the input capacity of the piezo-electric transformer 8, the terminal voltage of the capacitor 4 is stepped up by the piezo-electric transformer 8 thus causing a high AC voltage to be generated on the secondary side. When the AC voltage is negative, the diode 9*b* becomes conductive and charges the output capacity of the piezo-electric transformer 8. When the AC voltage is positive, the diode 9*a* is conductive, capacitor 10 is charged and its terminal voltage is gradually increased. Thus, when the terminal voltage of the capacitor 10 reaches the break down voltage of the discharging gap 11; discharge takes place gas ignition. In this case, even if one discharge fails to produce gas ignition, a further discharge immediately follows as long as the switch 12 is on thus assuring reliable gas ignition. Further, since only turning on and off the switch 12 is sufficient and it is not required to apply external force to a piezo-electric element as in the prior art, the device according to the present invention can be operated by only a light touch without any noise accompanying the operation.

Next, referring to FIGS. 2 and 3 which illustrate the behavior of the circuit when the capacitor 10 is charged by means of the piezo-electric transformer 8, reference numeral 14 is the output capacity of the piezo-electric transformer 8 having a value $C_1$. The energy storing capacitor 10 has a capacity $C_2$ which is much larger than the capacitor $C_1$. Numeral 15 represents the output voltage of the piezo-electric transformer 8. Assuming the voltage difference between the maximum and minimum values of the output voltage is $E_o$, the terminal voltage of the output capacity 14 is charged up to $E_o/2$ during the first negative half-cycle. At the end of the succeeding positive half-cycle, the capacitor 10 is charged up to the voltage $E_o \cdot C_1/(C_1 + C_2)$. During the succeeding negative half-cycle, the output capacity 14 is again charged and, at the end of the succeeding positive half-cycle, the terminal voltage of the capacitor 10 is increased by $C_1(C_1 + C_2)$ times the voltage applied to the diode (9a). As a result of the repetition of the above cycles, the terminal voltage of the capacitor 10 is increased gradually up to $E_C$. When the terminal voltage reaches the break down voltage $E_B$ of the discharging gap 11 as a result of n times repetition, discharge takes place and the terminal voltage of the capacitor 10 is decreased to the discharge diminishing voltage $E_D$ at which time, however, the capacitor 10 again begins to be charged. Thus, the above-mentioned cycles are repeated. Consequently, even if ignition initially fails to be made, discharge continues until complete ignition occurs.

As described above, in the above-described embodiment, gas ignition can be made reliably by only lightly turning on the switch without any noise accompanying the operation as in the prior art and further the repeated operations because of failure in ignition are not required as in the prior art. Still further, since two diodes are used to supply energy in a manner of time division from the piezo-electric transformer to the energy storing capacitor, the piezo-electric transformer can be made compact, that is, there is provided a gas ignition device which is compact, light and very simple to handle. When, in the self-oscillation circuit, the conduction time interval of the transistor 1 is so lengthened that the transistor 1 operates at class B rather than class C, the fundamental wave component of the collector current becomes large and, as a result, the output power of the oscillation transformer 3 becomes large while the collector loss is disadvantageously increased. Accordingly, the conduction time interval of the transistor 1 in the above-described embodiment is adjusted by the use of the base-emitter junction of the transistor 1, the bias resistor 2, the capacitor 5, the resistor 6 and the diode 7 so that the circuit may be kept at a maximum efficiency and the consumption of the battery may be advantageously controlled.

Referring to FIG. 4 which shows embodiment of the present invention, reference numeral 1 is a self-oscillation transistor which operates at class C. Numeral 2 is a bias resistor for starting the oscillation of the transistor 1, numeral 3 is an oscillation transformer, numerals 4 and 5 are capacitors which adjust the phase of the feedback loop so as to satisfy the oscillation condition, numeral 6 is a resistor which limits the base current of the transistor 1, numeral 7 is a diode which serves to lengthen the conduction time interval of the transistor 1, numeral 8 is a piezo-electric transformer which steps up the oscillation voltage generated in the capacitor 4 thereby serving as a high voltage source, numeral 9 is a switching element which comprises two diodes 9a and 9b connected as shown in the drawings and transfers the high voltage energy generated on the secondary side of the piezo-electric transformer 8 to an energy storing capacitor 10, numeral 11 is a discharging gap and numeral 20 is a switch which is positioned at the terminal A when the transistor 1 is not operated and at the terminal B when the transistor 1 is operated. Numeral 13 is a battery and numeral 14 is a source energy storing capacitor. The transistor 1, the bias resistor 2, the oscillation transformer 3, the capacitors 4 and 5, the resistor 6, the diode 7 and the piezo-electric transformer 8 constitute a self-oscillation circuit. When the switch 20 is positioned at the terminal A, energy is stored in the source energy storing capacitor 14; while, when the switch 20 is positioned at the terminal B, a discharge circuit of the capacitor 14 is constituted so as to give a bias through the oscillation starting bias resistor 2 to the base of the transistor 1 thereby activating the self-oscillation circuit. Thus, the output voltage of the oscillation circuit which is generated across the terminals of the capacitor 5 is stepped up by the piezo-electric transformer 8 and, as a result, a high AC voltage is generated on the secondary side. When the high AC voltage is negative, the diode 9b is conductive to charge the output capacity of the piezo-electric transformer 8. When the high AC voltage is positive, the diode 9a is conductive to charge the energy storing capacitor 10 thereby stepping up the terminal voltage. Thus, when the terminal voltage reaches the break down voltage of the discharging gap 11, discharge begins. Though, due to the discharge, the terminal voltage of the energy storing capacitor 10 is made lower than the discharge diminishing voltage, the energy storing capacitor 10 is charged again by the piezo-electric transformer 8; thus, the above-described process is repeated. These cycles of charging and discharging continue until the energy in the source energy storing capacitor 14 is decreased so as to be incapable of starting the self-oscillation circuit. When the source energy storing capacitor 14 has completely lost its energy, self-oscillation does not occur even if the switch 20 is at position B. Since gas ignition is made with the discharge energy in these cycles of charging and discharging and usually within a few discharges, it is possible, by setting the source energy storing capacitor 14 at such a capacity value as to stop the self-oscillation in a few cycles, that wasteful discharge in lighting a cigarette is controlled at a minimum level.

As described above, in the embodiment shown in FIG. 4, ignition can be made by only turning on the switch without any noise accompanying the operation as in the prior art and, even in the case of failure in ignition, ignition is assured by the succeeding cycles of charging and discharging. Further, since the number of cycles is suitably limited, wasteful discharge can be kept at the minimum and, as a result, the battery can be prevented from being consumed wastefully.

As described hereinbefore, in accordance with the present invention, there is provided an excellent gas ignition device for lighters.

What is claimed is:

1. A gas ignition device for operation from a D.C. power supply having first and second terminals comprising:

a resistor and a diode connected in series across the terminals of said D.C. power supply, a transistor having an emitter connected to the second terminal of said D.C. power supply and a base connected to the junction of said resistor and said diode, an oscillation transformer having a secondary winding and a primary winding, said primary winding being connected between the first terminal of said D.C. power supply and the collector of said transistor, a first capacitor connected in parallel with the secondary winding of said oscillation transformer, a piezoelectric transformer having first and second primary side electrodes and a secondary side electrode, the secondary winding of said oscillation transformer being connected between the first terminal of said D.C. power supply and the first primary side electrode of said piezoelectric transformer, a second capacitor connected between the second terminal of said D.C. power supply and the second primary side electrode of said piezoelectric transformer, a feedback circuit for coupling the voltage at the junction of said second capacitor and said piezoelectric transformer back to the base of said transistor, a rectifying circuit having an input terminal coupled to the secondary side electrode of said piezoelectric transformer for rectifying the A.C. high voltage generated by said piezo-electric transformer, a common terminal connected to the second terminal of said D.C. power supply, and an output terminal, a third capacitor connected to the output terminal of said rectifying circuit, said capacitor storing the output voltage of said rectifying circuit, and a discharging gap connected in parallel with said third capacitor.

2. A gas ignition device for operation from a D.C. power supply having first and second terminals comprising:

a switch having a common terminal, a first terminal connected to the first terminal of said D.C. power supply, and a second terminal, a resistor and a diode connected in series between the second terminal of said switch and the second terminal of said D.C. power supply, a transistor having an emitter connected to the second terminal of said D.C. power supply and a base connected to the junction of said resistor and said diode, an oscillation transformer having a secondary winding and a primary winding, said primary winding being connected between the first terminal of said D.C. power supply and the collector of said transistor, a first capacitor connected in parallel with the secondary winding of said oscillation transformer, a piezoelectric transformer having first and second primary side electrodes and a secondary side electrode, the secondary winding of said oscillation transformer being connected between the first terminal of said D.C. power supply and the first primary side electrode of said piezoelectric transformer, a second capacitor connected between the second terminal of said D.C. power supply and the second primary side electrode of said piezoelectric transformer, a feedback circuit for coupling the voltage at the junction of said second capacitor and said piezoelectric transformer back to the base of said transistor, a rectifying circuit having an input terminal coupled to the secondary side electrode of said piezoelectric transformer for rectifying the A.C. high voltage generated by said piezo-electric transformer, a common terminal connected to the second terminal of said D.C. power supply, and an output terminal, a third capacitor connected to the output terminal of said rectifying circuit, said capacitor storing the output voltage of said rectifying circuit, a discharging gap connected in parallel with said third capacitor, and a fourth capacitor connected between the common terminal of said switch and the second terminal of said D.C. power supply.

* * * * *